US005924221A

United States Patent [19]

Schuver et al.

[11] Patent Number: 5,924,221

[45] **Date of Patent: *Jul. 20, 1999**

[54] FOOTWEAR HAVING FRAGRANCE RELEASING MEANS

[75] Inventors: Steven S. Schuver; David D. Schuver, both of St. Louis, Mo.

[73] Assignee: SBH, Inc., St. Louis, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/919,400

[22] Filed: Aug. 28, 1997

[51] Int. Cl.[6] ..... A43B 23/00

[52] U.S. Cl. ..... 36/136; 36/3 A; 36/3 B

[58] Field of Search ..... 36/136, 3 R, 3 A, 36/3 B, 1

[56] References Cited

U.S. PATENT DOCUMENTS

| | | | |
|---|---|---|---|
| 4,155,123 | 5/1979 | Popper | 2/239 |
| 4,186,502 | 2/1980 | Foster | 36/136 |
| 4,257,176 | 3/1981 | Hartung et al. | 36/44 |
| 4,493,869 | 1/1985 | Sweeny et al. | 428/201 |
| 4,517,308 | 5/1985 | Ehlenz et al. | 502/401 |
| 4,528,226 | 7/1985 | Sweeny | 428/40 |
| 4,864,740 | 9/1989 | Oakley | 36/44 |
| 4,889,338 | 12/1989 | Keijiro | 273/73 G |
| 5,024,008 | 6/1991 | Maples | 36/136 |
| 5,148,949 | 9/1992 | Luca | 222/175 |
| 5,261,169 | 11/1993 | Williford | 36/43 |
| 5,268,214 | 12/1993 | Charbonneau | 428/195 |
| 5,567,006 | 10/1996 | Smith | 424/404 |

OTHER PUBLICATIONS

3M Promotional Fragrance Products Fact Sheets.

*Primary Examiner*—Ted Kavanaugh
*Attorney, Agent, or Firm*—Haverstock, Garrett & Roberts

[57] ABSTRACT

Footwear comprising a portion of fragrance releasing material associated with the footwear is disclosed with the fragrance being capable of being released from the portion of the footwear. The footwear further comprises a second portion of fragrance releasing material associated with the footwear for releasing a second fragrance.

8 Claims, 2 Drawing Sheets

FOOTWEAR HAVING FRAGRANCE RELEASING MEANS

BACKGROUND OF THE INVENTION

This invention relates to footwear having fragrance releasing means and in particular to footwear having microencapsulated materials bounded to a surface for release of a scent or fragrance.

Footwear, most notably athletic footwear, has evolved to such a state that in addition to its primary purposes of providing support and protection for the foot it has taken on other functions. For example, one of these other known functions consists of including inflatable bladders in each shoe to be inflated by the wearer to provide for a better fit. Another known function is to include lights around the sole of the shoe or at the heel portion of the shoe to have a visual display. One example of such a shoe is disclosed in U.S. Pat. No. 4,848,009. Another known function of footwear is to include means for generating music for the wearer of the shoe to play music during use of the footwear. Two examples of such means for generating music are disclosed in U.S. Pat. Nos. 4,571,680 and 5,615,111, both of which are assigned to the assignee of this application. Additionally, footwear manufacturers are continuously looking for other functions to increase sales. Therefore it would be advantageous to have footwear having an additional function such as being able to release a fragrance or scent for the user of the footwear to smell during use or storage of the footwear. Additionally, it would be advantageous to have footwear which allows the wearer to be able to release various different fragrances or scents. It would further be advantageous to have footwear which serves a dual function of being a useful shoe in combination with an amusement device.

SUMMARY OF THE INVENTION

Generally, one form of the invention is footwear comprising a portion having fragrance releasing means associated therewith, the fragrance being capable of being released from the portion of the footwear.

In another form the present invention is footwear having fragrance releasing means, the footwear has an upper portion and a sole portion, the footwear comprises a portion of material having fragrance releasing capability for releasing a fragrance.

In general, another form of the present invention is footwear having fragrance releasing means, the footwear has an upper portion and connected thereto a sole portion, the footwear comprises a portion of material having microcapsules carrying a fragrant liquid therein, the fragrant liquid being released whenever any of the microcapsules is ruptured.

In light of the foregoing comments, it will be recognized that a principal object of the present invention is to provide footwear having fragrance releasing means for a user of the footwear to be able to smell such fragrance.

A further object of the present invention is to provide footwear having fragrance releasing means which have different fragrance releasing means associated with the footwear.

Another object of the present invention is to provide footwear having fragrance releasing means which is simple and easy to use.

A still further object of the present invention is to provide footwear having fragrance releasing means which is convenient, economical, and reliable to use.

These and other objects and advantages of the present invention will become apparent after considering the following detailed specification in conjunction with the accompanying drawings, wherein:

DETAILED DESCRIPTION OF THE PREFERRED EMBODIMENT

Figure 1:
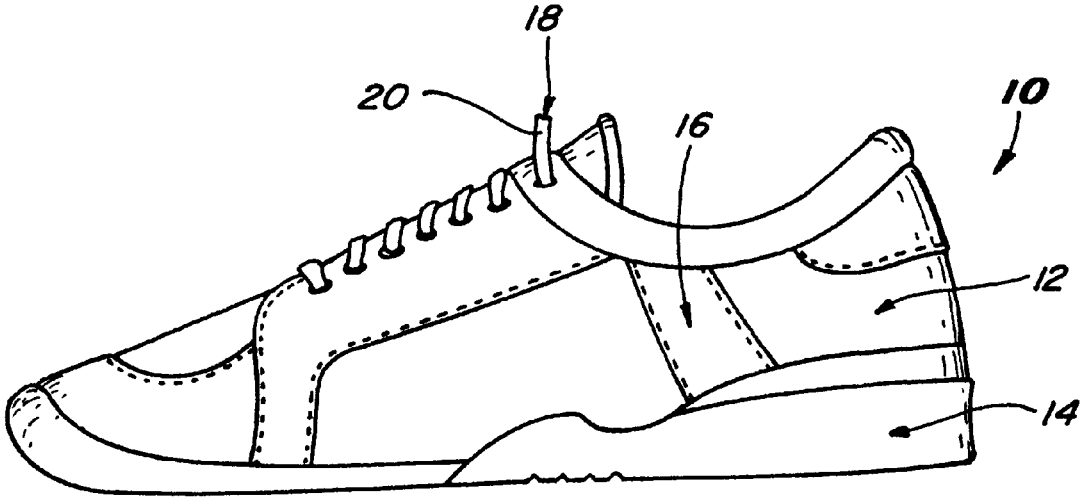
FIG. 1 is a perspective view of footwear having fragrance releasing means constructed acing to the present invention.

Referring now to the drawings, wherein like numerals refer to like items, number 10 identifies a preferred embodiment of footwear having fragrance releasing means which is constructed according to the present invention. With reference to FIG. 1, the footwear 10 has an upper portion 12 and a sole portion 14 connected to the upper portion 12. A strip or portion 16 of a fragrance releasing material is shown attached to or associated with the upper portion 12. The strip of material 16 may take many known forms such as scratch and sniff type fragrance releasing material, pull off remove type fragrance releasing material, air fresher type fragrance releasing material, and two layer type fragrance releasing material. Additionally, any known process of manufacturing, strip of material 16 may be employed. Such known methods of manufacturing include silk screening, letter pressed, and offset printing. Other known fragrance releasing materials include fragrance capsules which are powdered liquids which are provided as a wet cake to be blended with water based color inks to provide customized fragrance inks to be silk screened or printed on materials such as textiles, The capsules or particles which have encapsulated therein the fragrance or scent are small typically being on the order of 20 microns in diameter. In order to sample the scent one must scratch or rupture the surface of the fragrance releasing material and then smell the released scent. It is also known to include perfume pearls, a type of liquid perfume oil, so that not only can one smell the fragrance but can also apply the iridescent pearl powder to one's skin. Further, it is known to use powder based capsules or particles for the fragrance releasing means.

Two layer type fragrance releasing means consists of a self-adhesive label constructed of two film plys. When the top ply is lifted, the fragrance which is associated with the bottom ply can be sampled. Additionally, the top ply can be resealed over the bottom ply for further use. This product can be die cut in various shapes and sizes and can be incorporated within the footwear 10 as the strip 16.

As shown in FIG. 1, the strip of fragrance releasing material 16 is shown as being a generally rectangular shaped strip, however, any desired, shaped or sized may be employed as required. The strip 16 may be attached to the upper portion 12 by any suitable means, such as by sewing or gluing. In use a wearer of the footwear 10 uses or wears the footwear 10 in the usual manner, however, the strip 16 of fragrance releasing material may be employed to release a fragrance or scent. Depending upon the particular type of fragrance releasing means incorporated with the footwear 10, for example, scratch and sniff type, a user of the footwear 10 may simply scratch and sniff the strip 16 to release the fragrance.

Further, footwear 10 is shown to include a shoelace 18 which includes therein fragrance releasing means 20. Fragrance releasing means 20 may take any of the previously discussed forms. For example, capsules or particles which have encapsulated therein the fragrance or scent may be impregnated into the shoelace 18.

Figure 2:
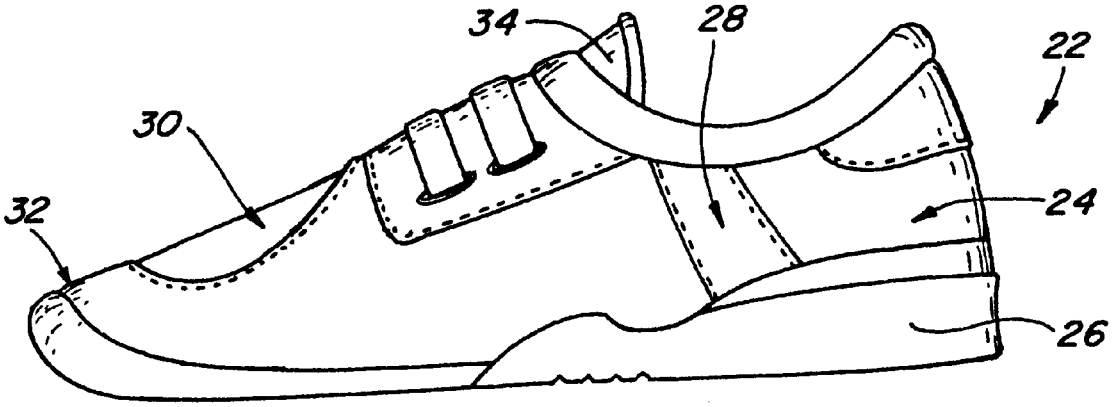
FIG. 2 is a perspective view of a second embodiment of footwear having fragrance releasing means constructed according to the present invention.

Referring now to FIG. 2, a second embodiment of footwear 22 having fragrance releasing means is illustrated. The footwear 22 is shown having an upper portion 24 connected to a sole portion 26. A first strip or portion 28 of a fragrance releasing material is shown attached to or associated with the upper portion 24. Additionally, a second strip or portion 30 of a fragrance releasing material is attached to or made to form a toe portion 32 of the footwear 22. Although the toe portion 32 is shown it is also possible to have the second strip 30 being part of the tongue 34 of the footwear 22. It being understood that the toe portion 32 or the tongue 34 are only examples of where the second strip 30 may be incorporated within the footwear 22. The portions 28 and 30 may be any of the type of fragrance releasing means previously described and disclosed. Additionally, portion 28 and 30 may be the same kind of fragrance releasing means or the portions 28 and 30 may be diff fragrance releasing means. Further, portions 28 and 30 may have the same fragrance or the portions 28 and 30 may each have a different fragrance.

Figure 3:
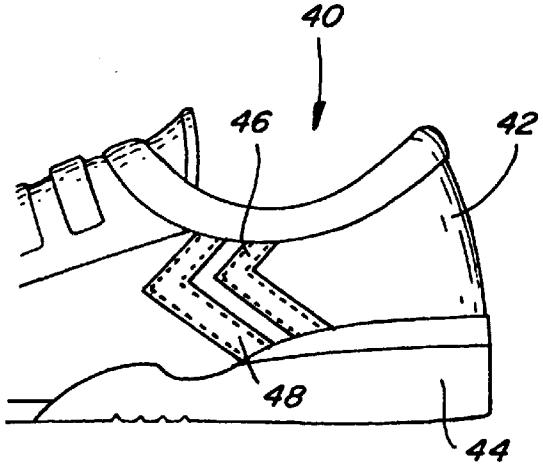
FIG. 3 is a perspective view of a third embodiment of footwear having fragrance releasing means constructed according to the present invention.

With reference now to FIG. 3, a third embodiment of footwear 40 having fragrance releasing means is shown. The footwear 40 comprises an upper portion 42 connected to a sole portion 44. A first strip 46 of fragrance releasing material is shown as a part of the upper portion 42 and a second strip 48 is also shown as another part of the upper portion 42. In this particular embodiment the first strip 46 and second strip 48 are shown to be complimentary shapes such as chevrons. In this manner the fragrance releasing material 46 and 48 serve as insignia for the footwear 40. Again, as explained above, the fragrance releasing material 46 and 48 can be constructed of any known fragrance releasing material by employing any method. Additionally, the first strip 46 and the second strip 48 may be made of the same type of fragrance releasing material or even different types of fragrance releasing materials. It is also contemplated that the first strip 46 may be of a different fragrance than the second strip 48. Further, the first strip 46 may be of the same color or a different color than the second strip 48. Although the first strip 46 and the second strip 48 are shown as chevrons in shape, it is also possible to have various other shapes or configurations.

Figure 4:
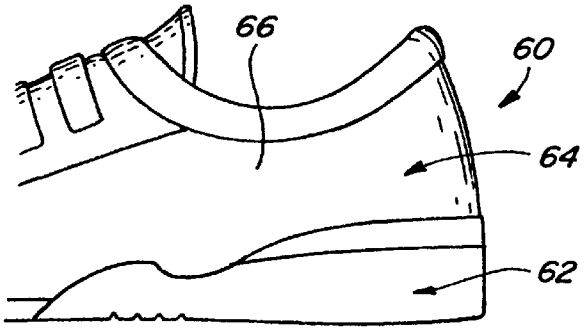
FIG. 4 is a partial perspective view of a fourth embodiment of footwear having fragrance releasing means constructed according to the present invention.

FIG. 4 illustrates another embodiment of footwear 60 having fragrance releasing means. In particular, footwear 60 has a sole portion 62 connected in conventional manner to an upper portion 64. The upper portion 64 is constructed from a fragrance releasing material 66. For example, the fragrance releasing material 66 may be of the scratch and sniff variety and is formed in such a manner to be the upper portion 64. As outlined above, the fragrance releasing material 66 may take many forms.

Figure 5:
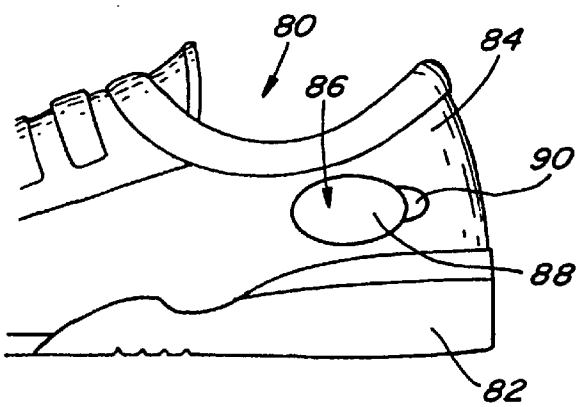
FIG. 5 is a partial perspective view of a fifth embodiment of footwear having fragrance releasing means constructed according to the present invention.

With reference now to FIG. 5, a further embodiment of footwear 80 having fragrance releasing means is illustrated. The footwear 80 has a sole portion 82 connected to an upper portion 84. The upper portion 84 has a two layer type fragrance releasing device 86 adhered to the upper portion 84. The two layer device 86 is shown having a top ply layer 88 closed over a bottom ply layer (not shown). Additionally, the top ply layer 88 has a pull tab 90 from opening and closing the top ply layer 88 to release the fragrance associated with the bottom ply layer. Although one such two layer device 86 is shown it is also possible to have more than one such device 86 placed about the upper portion 84. Additionally, the two layer device 86 may be configured in any shape required.

Figure 6:
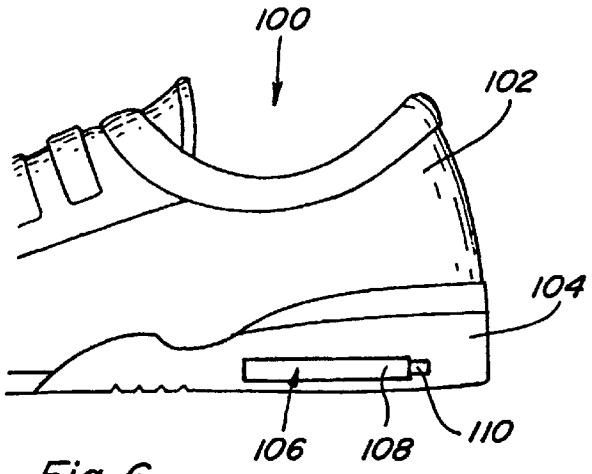
FIG. 6 is a partial perspective view of a sixth embodiment of footwear having fragrance releasing means constructed according to the present invention.

FIG. 6 depicts another embodiment of footwear 100 having fragrance releasing means. The footwear 100 has an upper portion 102 adapted to be connected to a sole portion 104. The sole portion 104 has adhered thereto a two layer type fragrance releasing device 106. The two layer device 106 has a top ply layer 108 which covers a bottom ply layer (not shown). The top ply layer 108 has a pull tab 110 for opening the top ply layer 108 to expose the bottom ply layer. The bottom ply layer has a fragrance incorporated therein and once the top ply layer 108 is opened the fragrance is released. Additionally, the top ply layer 108 may be closed for reusing the fragrance. Although one such device 106 is shown in conjunction with the sole portion 104 it is possible to have more than one such device 106 adhered along the sole portion 104. The device 106 may also be produced in any shape desired. It is further contemplated that the sole portion 104 may be constructed of any other fragrance releasing means as mentioned in the above discussion of possible fragrance releasing means. Additionally, the upper portion 102 and the sole portion 104 may both include fragrance releasing means.

Although the preferred embodiments of footwear have been illustrated and described as being athletic type shoes or footwear, it should be recognized that footwear of the present invention may be incorporated in different footwear. For example, the teachings of the present invention are suitable for boots, dress shoes, sandals, slippers, ski boots, ice skates, in-line skates, roller skates, and thongs or any other footwear. Additionally, footwear of the present invention can be constructed of various materials and can be assembled from separable components or formed as a unitary construction.

From all that has been said, it will be clear that there has thus been shown and described herein footwear having fragrance releasing means which fulfills the various objects and advantages sought therefor. It will be apparent to those skilled in the art, however, that many changes, modifications, variations, and other uses and applications of the subject footwear having fragrance releasing means are possible and contemplated. All changes, modifications, variations, and other uses and applications which do not depart from the spirit and scope of the invention are deemed to be covered by the invention, which is limited only by the claims which follow.

What is claimed is:

1. Footwear having an upper portion having an exterior surface and a sole portion comprising a portion of fragrance releasing means attached to the exterior surface of the upper portion, the portion presenting a surface which may be scratched by a user with the full surface being accessible to a user and wherein the portion of fragrance releasing means comprises a shoelace.

2. The footwear of claim 1 wherein the portion of fragrance releasing means comprises microencapsulated perfume with the perfume being released when pressure is applied to the microencapsulated perfume.

3. The footwear of claim 1 further comprising a second portion of fragrance releasing means attached to the exterior surface of the upper portion, the second portion presenting a surface which may be scratched by a user with the full surface being accessible to a user.

4. The footwear of claim 3 wherein the first portion has a first fragrance and the second fragrance has a second fragrance.

5. The footwear of claim 4 wherein the first and second fragrances are different from each other.

6. Footwear having fragrance releasing means, the footwear having an upper portion having an exterior surface and connected thereto a sole portion, the footwear comprising a portion of material having microcapsules carrying a fragrant liquid therein, the fragrant liquid being released whenever any of the microcapsules is ruptured and the material being attached to the exterior surface of the upper portion, the portion of material having a surface which allows a user to rupture the microcapsules with the entire surface being accessible to a user for rupturing the microcapsules and wherein the portion of material is a shoelace.

7. The footwear of claim 6 further comprising a second portion of material having microcapsules carrying a fragrant liquid therein, the fragrant liquid being released whenever any of the microcapsules is ruptured and the second portion of material being attached to the exterior surface of the upper portion.

8. The footwear of claim 7 wherein the fragrant liquid associated with the first portion is different than the fragrant liquid associated with the second portion.

* * * * *

UNITED STATES PATENT AND TRADEMARK OFFICE

CERTIFICATE OF CORRECTION

PATENT NO. : 5,924,221
DATED : July 20, 1999
INVENTOR(S) : Steven S. Schuver and David D. Schuver It is certified that error appears in the above-identified patent and that said Letters Patent is hereby corrected as shown below:

Column 2,
Line 9, "acing" should be -- according --.
Line 39, "fresher" should be -- freshener --.
Line 41, "manufacturing," should be -- manufacturing the --.
Line 48, "textiles," should be -- textiles. --.

Column 3,
Line 34, "diff" should be -- different kinds of --.

Column 5,
Line 9, the second occurrence of "fragrance" should be -- portion --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*